US010835797B2

(12) United States Patent
Wharton

(10) Patent No.: US 10,835,797 B2
(45) Date of Patent: Nov. 17, 2020

(54) BOARD BREAKING APPARATUS AND METHOD

(71) Applicant: Anthony James Wharton, Akron, OH (US)

(72) Inventor: Anthony James Wharton, Akron, OH (US)

( * ) Notice: Subject to any disclaimer, the term of this patent is extended or adjusted under 35 U.S.C. 154(b) by 0 days.

(21) Appl. No.: 16/199,318

(22) Filed: Nov. 26, 2018

(65) Prior Publication Data

US 2019/0192940 A1 Jun. 27, 2019

Related U.S. Application Data

(60) Provisional application No. 62/608,741, filed on Dec. 21, 2017.

(51) Int. Cl.

| | |
|---|---|
| ***A63B 69/00*** | (2006.01) |
| ***A63B 69/26*** | (2006.01) |
| ***A63B 69/24*** | (2006.01) |
| ***A63B 69/20*** | (2006.01) |

(52) U.S. Cl.

CPC ..... *A63B 69/004* (2013.01); *A63B 69/20* (2013.01); *A63B 69/24* (2013.01); *A63B 69/26* (2013.01); *A63B 2069/0042* (2013.01); *A63B 2225/09* (2013.01); *A63B 2244/106* (2013.01)

(58) Field of Classification Search

CPC .... A63B 69/004; A63B 21/0552; A01K 97/10

USPC ..... 248/230.1, 218.4, 219.1, 219.2, 219.3; 482/83

See application file for complete search history.

(56) References Cited

U.S. PATENT DOCUMENTS

| | | | | |
|---|---|---|---|---|
| 1,826,469 | A * | 10/1931 | Hunt | G09F 7/20 40/533 |
| 4,572,504 | A | 2/1986 | DiBartolo | |
| 6,647,652 | B1 * | 11/2003 | Seiber | G09F 7/18 40/606.1 |
| 6,913,233 | B2 * | 7/2005 | Puett, III | F16B 5/0692 116/173 |
| 7,121,986 | B1 | 10/2006 | O'Dowd | |
| 10,396,425 | B2 * | 8/2019 | Ohlsson | H01Q 1/1228 |
| 2005/0029419 | A1 * | 2/2005 | Ware | F16L 3/137 248/218.4 |
| 2005/0127258 | A1 * | 6/2005 | Lapointe | G09F 7/18 248/218.4 |
| 2013/0146726 | A1 * | 6/2013 | Bobrow | F16M 13/02 248/230.1 |

* cited by examiner

*Primary Examiner* — Steven M Marsh

(74) *Attorney, Agent, or Firm* — Jacob M. Ward; Ward Law Office LLC

(57) ABSTRACT

A board holder that is adapted for martial arts training has an elongate rod and at least one clamp disposed on an exterior surface of the elongate rod. The at least one clamp has a first clamping wall and a second clamping wall. The first and second clamping walls are adapted to secure a board. The board holder may also have a mount that is configured to be secured to a wall or a punching bag. Advantageously, a person may grip the board holder during training, as well as secure the board holder to the wall or punching bag.

12 Claims, 5 Drawing Sheets

BOARD BREAKING APPARATUS AND METHOD

CROSS REFERENCE TO RELATED APPLICATIONS

This application claims the benefit of U.S. Provisional Application Ser. No. 62/608,741, filed on Dec. 21, 2017. The entire disclosure of the above application is hereby incorporated herein by reference.

FIELD

The present disclosure relates to a board holder, and more specifically, to a board holder adapted for martial arts training.

BACKGROUND

In the field of martial arts, one of the most recognized and popular activities is the art of board breaking. Many traditional martial arts schools use board breaking to determine whether a student has reached the next level of training. For example, Taekwondo martial artists are expected to display technical skill in a proper Taekwondo manner, as well as showmanship and creativity. Competitors may choose the kind of techniques and number of boards to break, up to a maximum of fifteen boards. Any Taekwondo striking or kicking technique may be used, with the exception of head strikes. Competitors may perform as many breaking techniques as they wish, as long as they do not exceed the time limit.

In board breaking tournaments, competitors must correctly use executed hand and foot techniques to break boards. Individual standardized wooden boards are used and may range from nominal sizes as small as 6"×12"×1" to as large as 12"×12"×1" (a board with a nominal width of 1" has an actual width of ¾"). The typical adult testing board is approximately 10"×12"×1". Children may use narrower and thinner boards, with 4- and 5-year-olds sometimes breaking boards as small as 4"×12"×½". There are also plastic boards made of different composites, which can be used to vary the difficulty level involved in the board breaking.

Typically, the board(s) is held on respective sides by a person, who hold the board(s) and getting hurt while holding a board is no fun. Manually holding boards can result in injury to the persons holding the boards because of one or more factors, such as the inaccuracy of the practitioner, the shattering of the boards upon being struck, fingers of the holding persons on the striking surface of the board, broken boards twisting or slipping out of the holder's grasps, etc. In addition, improper holding of the board, the hands may be kicked while holding the board, or the holder may be injured by the forcefully moving hand, arm, foot, or head of the striker.

Another over-looked aspect of board breaking is the inability of finding a person to practice board-breaking when alone. When breaking boards, whether rebreakable or wood, the board breaker usually needs a partner or person to hold the boards. If no one is around, or if family members are reluctant to assist by holding the boards, one may be limited to downward breaks with the boards resting on cinder blocks or some other supports. If one wants to practice more common techniques like punches, knife hands, or elbow strikes, finding a person to practice with may be very difficult.

Illustrative of prior devices which simulate board breaking-holders are those described below. For example, U.S. Pat. No. 7,121,986 to O'Dowd teaches a device that includes a frame having at least four frame members, including two generally parallel and oppositely spaced apart lengthwise members, and two generally parallel and oppositely spaced apart widthwise members. In a further example, U.S. Pat. No. 4,572,504 to DiBartolo teaches a holder for breakable karate boards includes upper and lower spaced apart horizontal frame members that are secured to a vertical support, which mounts to wall.

There is a continuing need for a board holder that militates against injury to persons assisting a student practicing board breaking. Desirably, the board holder also allows students to practice breaking boards independently or without the need for a person to hold the board holder.

SUMMARY

In concordance with the instant disclosure a board holder that militates against injury to persons assisting a student practicing board breaking, and which also allows students to practice breaking boards independently or without the need for a person to hold the board holder, has been surprisingly discovered.

In one embodiment, a board holder has an elongate rod with an exterior surface, a male end, and a female end. At least one clamp is disposed on the exterior surface of the elongate rod. The at least one clamp has a first clamping wall and a second clamping wall. The first clamping wall and the second clamping wall are each adapted to secure a board.

In another embodiment, a first board holder and a second board holder may be placed in a stacked arrangement. The first board holder and the second board holder each include an elongate rod having an exterior surface, a male end, and a female end. At least one clamp is disposed on the exterior surface of each elongate rod. Each clamp has a first clamping wall and a second clamping wall. The first clamping wall and the second clamping wall of each clamp are adapted to secure a board. The male end of the first board holder is disposed in the female end of second board holder, thereby forming the stacked arrangement.

In a further embodiment, a method includes a first step of providing a board holder with an elongate rod. The elongate rod has an exterior surface, a male end, and a female end. At least one clamp is disposed on the exterior surface of the elongate rod. The at least one clamp has a first clamping wall and a second clamping wall. The first clamping wall and the second clamping wall are each adapted to secure a board. The method further includes a second step of providing a board. In a third step a user grasps the board holder. A fourth step of the method includes inserting the board in between the first clamping wall and the second clamping wall. In a fifth step of the method, the user moves the board holder to a desired position for a breaking of the board.

The board holder is a device that firmly grips and holds various popular kinds of martial arts boards. The device is designed to accommodate individuals in competition, team demonstration, testing, and practice. The device may be hand-held, mounted on a wall or flat surface, mounted on a kick bag or used with an independent stand.

The device has an elongate connecting body that connects a clamp to secure and and hold various popular kinds of martial arts boards on both ends. The clamp also has a sleeve-like opening on both ends, which allows a rod or pipe to be inserted into one end portion of the sleeve and exit through the opposite end of the device. The elongated rod allows a person to hold the rod and avoid injuries to the holder's hands during board breaking. The rod has male and female connecters that allow additional devices and boards to be added.

The clamps may be C-shaped and have grips that hold onto variously sized objects and martial arts boards that range from one-half inch (½") thick) to three-quarters inch (¾") thick to one inch (1") thick and more. In certain embodiments, the board holder may have two C-clamps with a first and second clamping wall to grasp onto the boards, and an elongate rod which varies in size and length.

In a specific example, the material or materials for the board holder may be a durable and flexible rubber, plastic, aluminum, steel, or the like. In particular, materials that may withstand 2300 pounds of pressure or blunt force may be employed. It should be understood that polyurethanes and polypropylenes are particularly durable and able to protect the holder's fingers, while also preventing or militating against injury to the striker who is hitting or kicking the board or target. The holder determines and controls the placement of the rod and boards.

In an exemplary embodiment, a board holder is a device that firmly grips and holding various popular kinds of martial arts boards. The device is designed to accommodate individuals in competition, team demonstration, testing, practice and it can be used as a hand-held, mounted on a wall or flat surface, mounted on a kick bag or used with an independent stand. This disclosure relates to a device for holding boards to be struck by a martial arts students or practitioner.

In light of the problems associated with the known methods and apparatus devices for martial arts board breaking, the present disclosure is designed to overcome all of the shortcomings of the prior art described above to eliminate the need for such manual holding of the board(s) to be broken. The device comprises an elongated arm crossbar that connects a C-clamp(s) to secured and firmly grips and holds various popular kinds of martial arts boards on both ends. The crossbar arm also has an upper oval sleeve-like opening on both ends which allows a rod or pipe to be inserted into one end portion of the sleeve and exit through the opposite end of the device. The elongated rod or pipe member that allows a person to hold the rod to avoid injuries to the holder's hands during board breaking. The rod or pipe member has a male and female connecter that allows additional devices and boards to be added.

It is an object of the present disclosure to provide C-clamp's having grips that holds onto various size objects martial arts boards that range from one-half inch (½") thick) to three-quarters inch (¾") thick to one inch (1") thick and more. To achieve the above and other objects, the present disclosure provides two C-clamp comprising an opening cylinder over each end of the clamp; a front flexible jaw; a rear flexible jaw the collapse and grasp on the boards, a elongate rod which varies in size and lengths, an extended that hold the clamps and device together and a durable device made of rubber, plastic, steel, aluminum and more to sustain pressure from blunt force or kick.

It is primary object of this disclosure to obviate injuries to the hand and wrist of the person holding the boards while engaging in the art martial arts.

A principal object of this disclosure is to provide a board holder device positioned where the practitioner may easily kick the boards.

One object of the disclosure is a martial arts portable board holding device that is adjustable to hold boards at a variety of different heights and angles.

Another object of the disclosure is a slidable board holding arm with clamps that hold boards vertically or generally horizontally to receive such kicks and other blows.

Another object of the disclosure is a rod or pipe that is portable and attached to the devices with the ability to add additional boards and devices.

Still yet another object of the disclosure is to provide martial arts practitioner a board holding device that can be used by mounting the device on a wall to practice at their home.

Yet another object of the disclosure is a martial arts board holding device that allows additional rods or pipes and devices to hold a desired number of boards.

Still another object of the present disclosure is to provide an apparatus which is simple in nature yet effective for purposes of supporting a board for board breaking exercises.

Yet another object of the present disclosure is to provide a wall mounting apparatus which is rugged in construction yet simple to construct.

Another object of this disclosure is to provide a fresh device of simplified construction and that is relatively inexpensive.

It is a further object of the disclosure to allow one person to hold a large number of boards so that a martial arts practitioner need not have multiple people hold the boards and arrange the boards and during practice sessions to recharge the holder with undamaged targets. So, practice sessions can continue unabated for long periods of time.

It is an object of the disclosure is to provide an improved board holder for the purposes described which is lightweight in construction, inexpensive to manufacture, and dependable in use.

A further object is to provide a board holder that is readily adjustable as to height, as well as on a vertical position, for holding the device and rod accordingly, and the holder supports the rod at an inclined angle relative to the upright of the holder desired.

DRAWINGS

The above, as well as other advantages of the present disclosure, will become readily apparent to those skilled in the art from the following detailed description, particularly when considered in the light of the drawings described herein.

Figure 8:
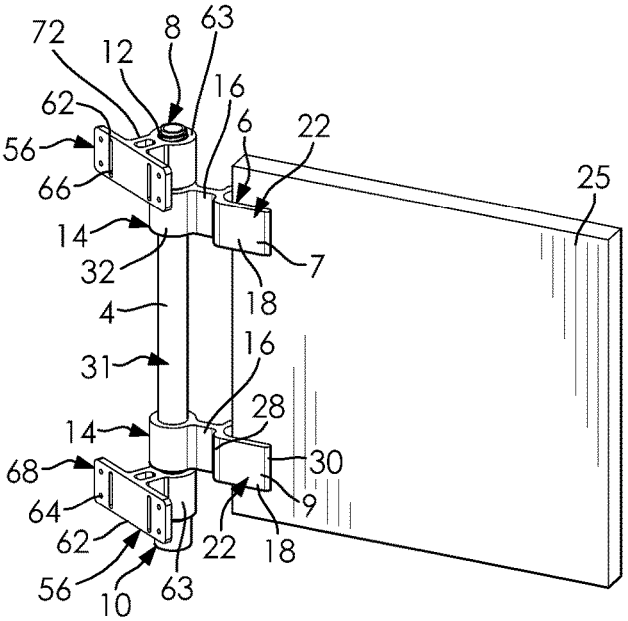
FIG. 8 is a top perspective view of the board holder with the single clamp shown in FIG. 5, and the mount shown in FIG. 7, each disposed on an elongate rod and securing a board.
Figure 10:
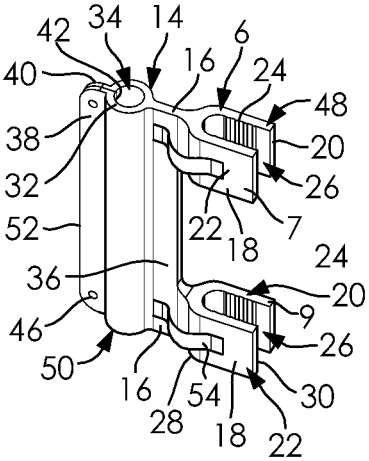
FIG. 10 is a top perspective view of a board holder according to an additional embodiment of the present disclosure.
Figure 16:
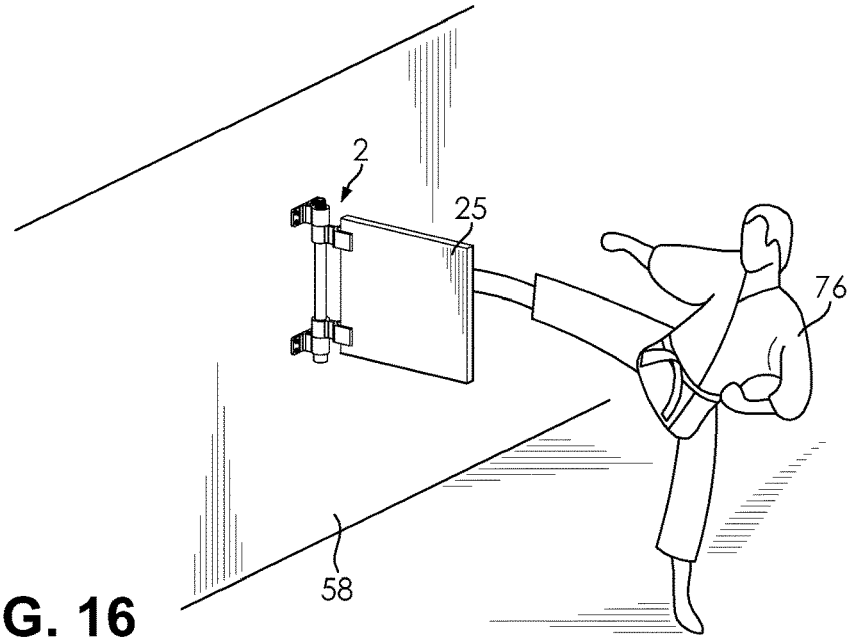
Figure 17:
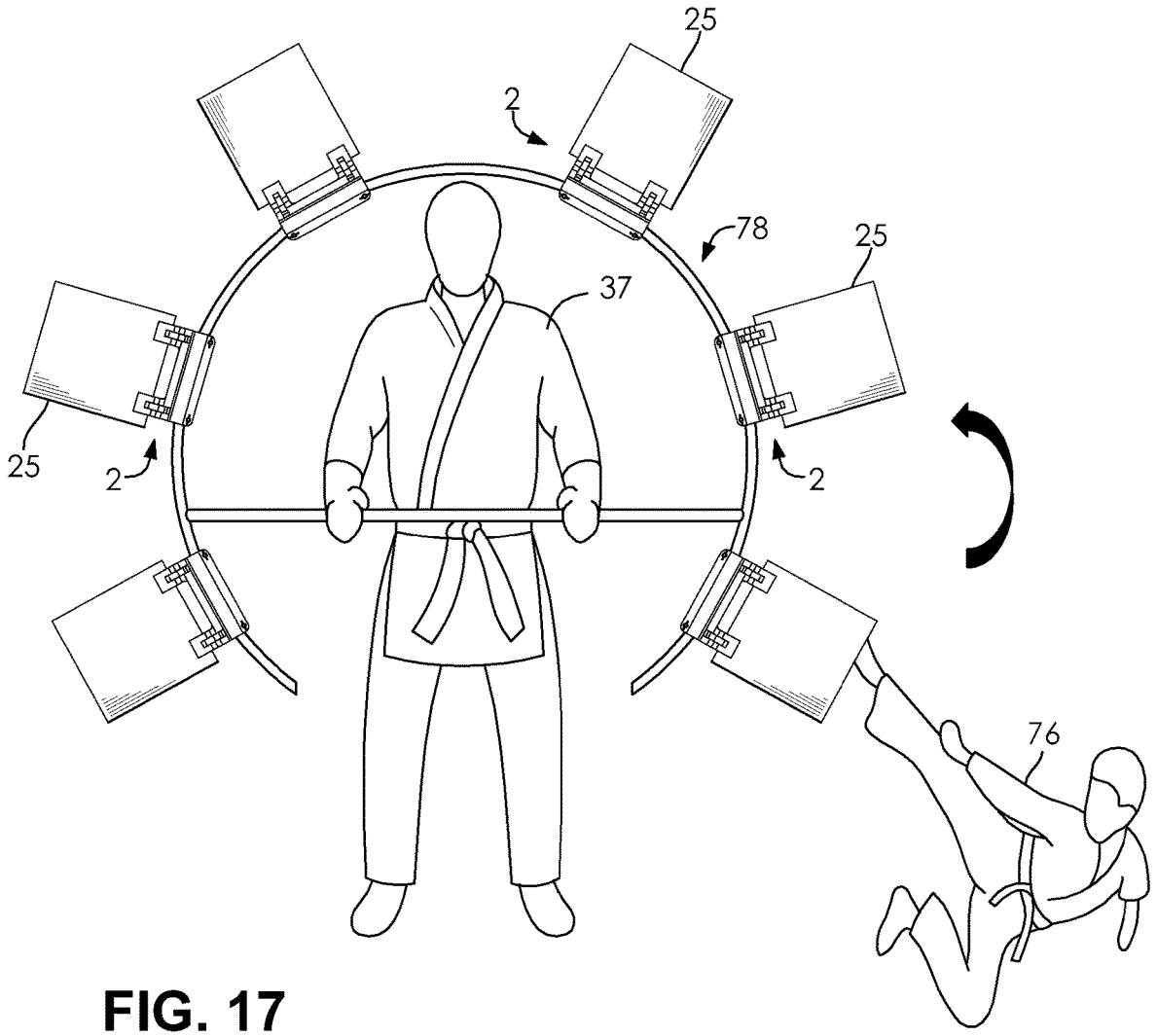

FIG. 16 is a top perspective view of the board holder shown in FIG. 8, the board holder shown attached to a wall and showing a student kicking a board secured to the board holder; and FIG. 17 is a front perspective view of a plurality of the board holders shown in FIG. 10, the board holders oriented in a C-shaped configuration, and each securing a board, and showing a student kicking one of the boards secured to one of the board holders.

DETAILED DESCRIPTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical unless otherwise disclosed.

FIGS. 1-17 illustrate a board holder 2 that is adapted for martial arts training. The board holder 2 may have an elongate rod 4 and at least one clamp 6. The elongate rod 4 may be formed from any suitably rigid material including, as non-limiting examples, aluminum, wood, and plastic. The at least one clamp 6 may include a plurality of clamps 6. For example, the plurality of clamps 6 may include a first clamp 7 and a second clamp 9. One of ordinary skill in the art may also select other numbers of clamps 6, 7, 9 within the scope of the present disclosure.

With further reference to FIGS. 1-17, the elongate rod 4 may have a male end 8 and female end 10. The male end 8 of the elongate rod 4 may be adapted to connect with the female end 10 of an opposing elongate rod 4. For example, as shown in FIGS. 1-17, the male end 8 may have an external male thread 12 and the female end 10 have an internal female thread (not shown) that is configured to receive the external male thread 12. In a further example, the female end 10 of the elongate rod 4 may be of a larger diameter than the male end 8, where the male end 8 is adapted to form a friction fit (not shown) with the female end 10. However, it should be appreciated that other suitable types of male and female configurations may be chosen by one skilled in the art.

With reference to FIGS. 2, 5, 10 and 12, each of the clamps 6 may have a clamp sleeve 14, a middle portion 16, a first clamping wall 18 and a second clamping wall 20. In certain embodiments, the first clamping wall 18 and the second clamping wall 20 may define a substantially C-shaped clamping body. In further embodiments, each of the clamping walls 18, 20 may have an outer surface 22 and an inner surface 24. The inner surface 24 of the first clamping wall 18 may be oriented toward the inner surface 24 of the second clamping wall 20.

The inner surface 24 of the first clamping wall 18 and the second clamping wall 20 may each have a retaining feature 26 to facilitate a gripping of a board 25, where the board 25 is disposed between the first clamping wall 18 and the second clamping wall 20. For example, with renewed reference to FIGS. 2, 5, 10, and 12, the retaining feature 26 may be a plurality of ribs. However, other retaining features 26 may be chosen by a skilled artisan such as a tape, sheet or film which bears a textured surface, as non-limiting examples.

Figure 2:
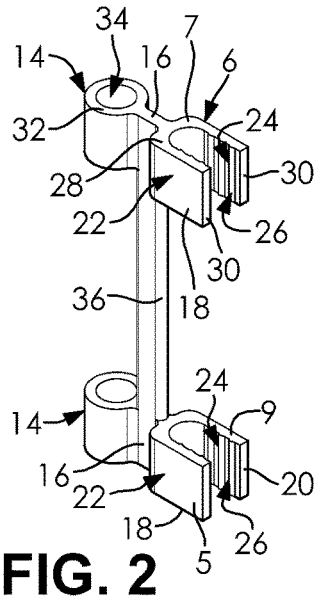
FIG. 2 is a top perspective view of a board holder with a first clamp and a second clamp according to another embodiment of the present disclosure.
Figure 3:
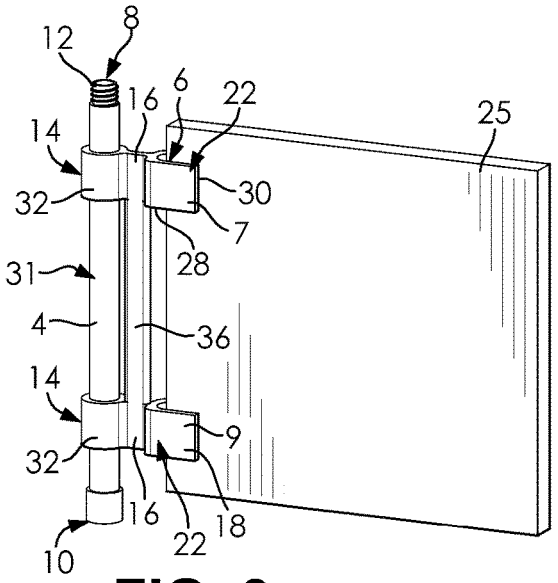
FIG. 3 is a top perspective view of the board holder shown in FIG. 2, illustrating the board holder disposed on an elongate rod and securing the board.

Each of the clamping walls 18, 20 may also have a proximal end 28 and a free distal end 30. The proximal end 28 of the clamping walls 18, 20 may be connected to the middle portion 16, while the free distal end 30 of the first clamping wall 18 may be oriented on a same plane as the free distal end 30 of the second clamping wall 20, for example, as shown in FIG. 2.

Figure 5:
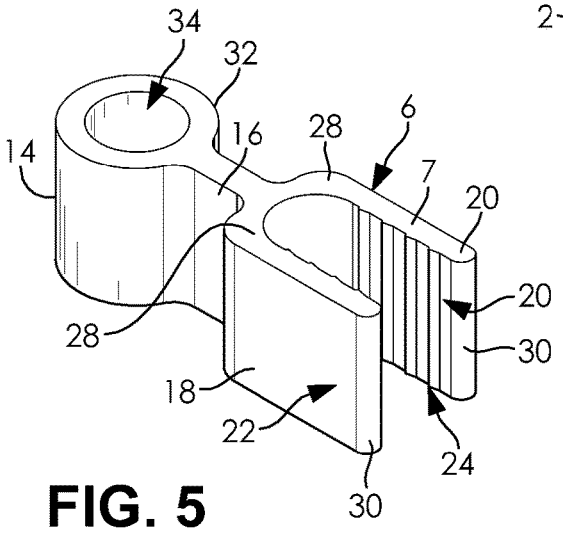
FIG. 5 is a top perspective view of a board holder with a single clamp according to a further embodiment of the present disclosure.
Figure 6:
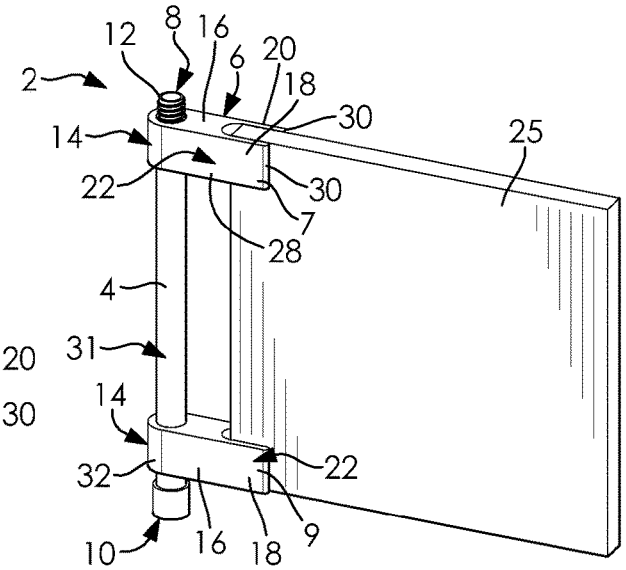
FIG. 6 is top perspective view of the board holder with a first clamp and a second clamp according to yet another embodiment of the present disclosure, the first clamp and the second clamp disposed on an elongate rod and securing a board.

In certain embodiments, as shown in FIGS. 1-5, and 9-17, the middle portion 16 of the clamp 6 may be disposed between the inner surface 24 of each clamping wall 18, 20. It should be appreciated the middle portion 16 may have a thickness that is less than a distance between the outer surfaces 22 of the clamping walls 18, 20, for example, as shown in FIG. 5. It should be understood that this may save on manufacturing or material costs. Additionally, in a further embodiment, as shown in FIG. 6, the middle portion 16 may be substantially flush with the outer surface 22 of the clamping walls 18, 20. It should be appreciated that the thickness of the middle portion being flush with the outer surfaces 22 of the clamping walls 18, 20 may optimize a durability of the clamp 6. Other configurations and thicknesses for the middle portion 16 may also be selected, as desired.

In particular embodiments, as shown in FIGS. 2-8 and 10-17, the clamp sleeve 14 may be slidably or removably secured to an exterior surface 31 of the elongate rod 4. For example, the clamp sleeve 14 may have a securing wall 32 defining an opening 34 that is adapted to receive the elongate rod 4. In a particular example, the clamp sleeve 14 may be substantially annular or O-shaped. However, other suitable shapes for the clamp sleeve 14 may also be employed within the scope of the disclosure.

Figure 1:
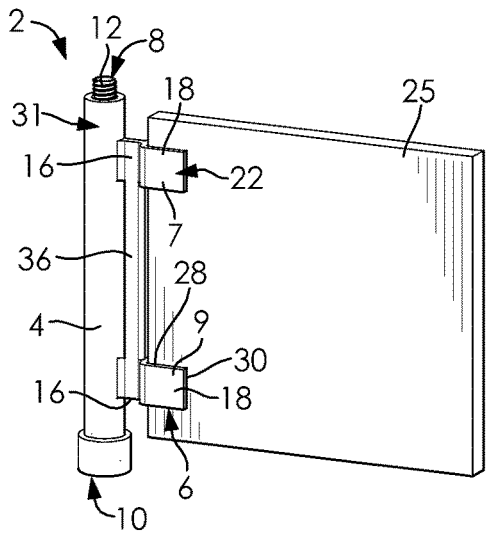
FIG. 1 is a top perspective view of a board holder according to one embodiment of the present disclosure, illustrating the board holder securing a board.
Figure 9:
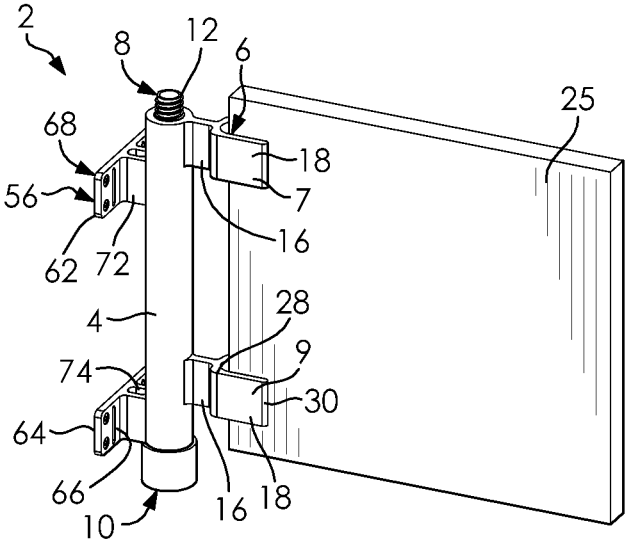
FIG. 9 is a top perspective view of a board holder according to a further embodiment of the present disclosure.

In further embodiments, shown in FIGS. 1 and 9, the clamps 6 may be employed without the clamp sleeve 14. Instead, the clamps 6 may be integrally molded as a single piece with (for example, in a single mold) or otherwise permanently connected to the elongate rod 4. It should be appreciated that the clamps 6 may be permanent attached to the elongate rod 4 through a variety of methods chosen by a skilled artisan.

Figure 13:
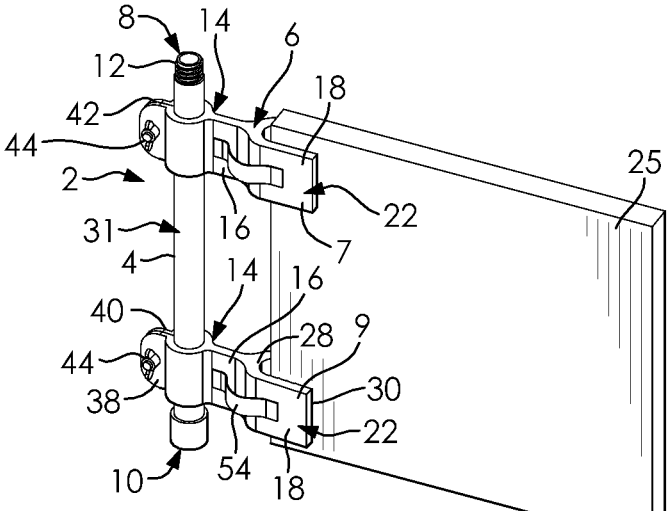
FIG. 13 is a top perspective view of two of the board holders shown in FIG. 12, with the board holders disposed on an elongate rod and securing a board.

With reference to FIGS. 6, 8 and 13, the first clamp 7 may be slidably secured to the elongate rod 4 and may be moved independently relative to the second clamp 9 along a length of the elongate rod 4. Similarly, the second clamp 9 may also be moved independently relative to the first clamp 7 along a length of the elongate rod 4. In this manner, a user is able to change positions of the first and second clamps 7, 9 along the length of the elongate rod 4, thereby allowing the clamps 6 to secure boards 25 of varying sizes.

In yet another embodiment, shown in FIGS. 2-4, and 10-11, the middle portion 16 of the first clamp 7 may be attached to the middle portion 16 of the second clamp 9 by an elongate connecting body 36. Advantageously, the elongate connecting body 36 militates against the movement of the first clamp 7 relative to the second clamp 9 along the length of the elongate rod 4, which optimizes stability of the board holder 2. Furthermore, the elongate connecting body 36 may be oriented substantially parallel to the elongate rod 4 to facilitate a gripping of the board holder 2 by a user 37, where the board 25 is not secured in the board holder 2. In certain embodiments, shown in FIGS. 2-4, the clamp sleeve 14 and middle portion 16 of the first clamp 7 may be spaced apart from the clamp sleeve 14 and middle portion 16 of the second clamp 9, where the elongate connecting body 36 separates the first clamp 7 from the second clamp 9.

With reference to FIGS. 2-8, in specific embodiments, the clamp sleeves 14 of each board holder 2 may be manufactured using an elastomeric material. The elastomeric material of the clamp sleeve 14 is adapted to surround the elongate rod 4 and secure the clamp 6 in a desired position. For example, the elastomeric material may be rubber, cotton elastic, polyester elastic, polypropylene elastic, and nylon elastic. However, other suitable elastomeric materials may be selected by one skilled in the art.

It should further be appreciated that at least a portion of the board holder 2 may have a pad or covering (not shown) that is configured to protect the holder's hand and the device itself if inadvertently kicked or hit by the practitioner. The padding may be a soft material, such as Styrofoam® or polyurethane rubber foam, as non-limiting examples. The padding may be selectively placed on the elongate rod 4, for example, in case the rod is kicked or hit by a student as they attempt to strike the board. Suitable thicknesses and other dimensions for the pad or covering may be selected by a skilled artisan, as desired.

With reference to FIGS. 10-13, in certain embodiments, a first flange 38 and a second flange 40 may be disposed on the securing wall 32 of the clamp sleeve 14. The first flange 38 may be spaced apart from the second flange 40, forming a gap 42 in the securing wall 32. For example, the first flange 38 and the second flange 40 may be disposed on opposite sides of the gap 42. The clamp sleeve 14 may be secured to the elongate rod 4 by selectively moving the first flange 38 closer to the second flange 40, which narrows the gap 42 in the securing wall 32 and lessens a width of the opening 34. Likewise, the user 37 may disconnect the clamp sleeve 14 from the elongate rod 4 by selectively moving the first flange 38 further from the second flange 40, which widens the gap 42 in the securing wall 32 and widens the width of the opening 34.

For example, at least one fastener 44 may be configured to selectively move the first flange 38 relative to the second flange 40, where the first flange 38 moves closer to the second flange 40 as the fastener 44 is tightened, and away from the second flange 40 as the fastener 44 is loosened. The fastener 44 may be a threaded fastener, such as a screw or bolt, for example. The fastener 44 may be disposed through at least one hole 64 formed in the first and second flanges 38, 40, which may be smooth bore or also threaded, as desired. In a particular example, shown in FIGS. 10-11, each flange 38, 40 may have two holes 46 and two fasteners 44 to secure the first flange 38 to the second flange 40. In a most specific example, the fastener 44 may be a thumb screw that joins with a nut (not shown). Other suitable types of fasteners 44 may also be chosen by one skilled in the art, as desired.

Figure 11:
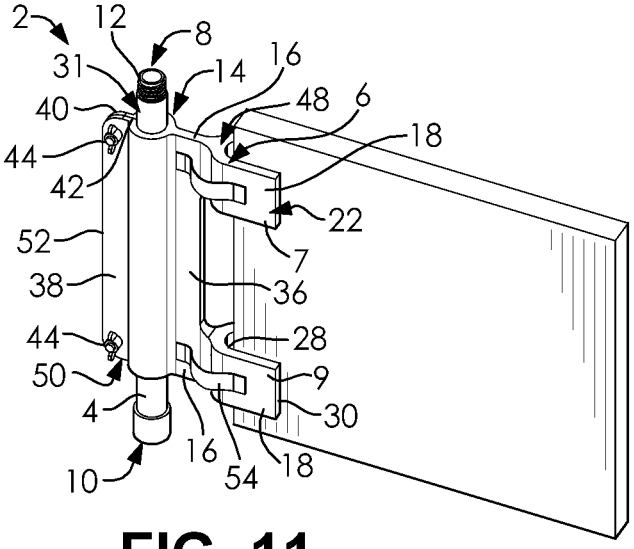
FIG. 11 is a top perspective view of the board holder shown in FIG. 10, the board holder disposed on an elongate rod and shown securing a board.
Figure 12:
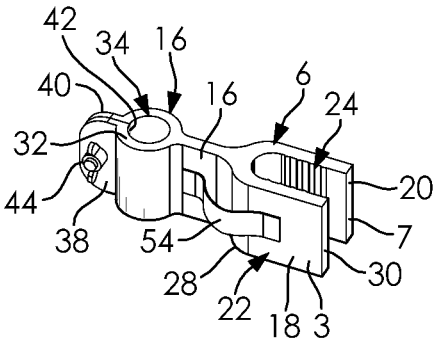
FIG. 12 is top perspective view of a board holder with a single clamp according to yet another embodiment of the present disclosure.

In certain embodiments, shown in FIGS. 10-11, the first flange 38 and the second flange 40 may each extend from a top surface 48 of the board holder 2 to a bottom surface 50 of the board holder 2. The top surface 48 is defined by the flanges 38, 40, the clamp sleeve 14, the middle portion 16, and the first and second clamping walls 18, 20 of the first clamp 7. The bottom surface 50 is defined by the flanges 38, 40, the clamp sleeve 14, the middle portion 16, and the first and second clamping walls 18, 20 of the second clamp 9.

The top surface 48 and the bottom surface 50 of the board holder 2 may extend from a terminal end 52 of each flange 38, 40 to the distal end 30 of each clamping wall 18, 20. Additionally, the top surface 48 of the board holder 2 may be oriented approximately parallel to the bottom surface 50 of the board holder 2. In certain embodiments, the clamp sleeve 14 may extend, uninterrupted, from the top surface 48 of the first clamp 7 to the bottom surface 50 of the second clamp 9. For example, the flanges 38, 40 and the clamp sleeve 14 may be of an equal length and may be integrally attached. Additionally, in certain embodiments, as shown in FIGS. 10-11, the middle portion 16 of the first clamp 7 may also be connected to the middle portion 16 of the second clamp 9 by the elongate connecting body 36, which may also be integral with the clamp sleeve 14.

In a further embodiment, shown in FIGS. 10-13, the outer surface 22 of the first clamping wall 18 and the second clamping wall 20 may each be reinforced by a biasing element 54. The biasing element 54 may be provided in the form of a spring or an arched spring-like structure, as a non-limiting example. It should be appreciated that the biasing element 54 reinforces the clamping walls 18, 20 and militates against an undesired disconnection of the board 25 from the board holder 2 in operation. Although explicitly shown in the embodiment of FIGS. 10-13, it should be appreciated that the biasing element 54 or spring may also be employed in all other embodiments contemplated and shown in the present disclosure.

As a further non-limiting example, each clamp 6 may be configured to hold the board 25 of a thickness between one-half (½) inch to one (1) inch. However, it should be appreciated that the clamps 6 may be adapted by a one skilled in the art to receive boards 25 of other thicknesses, as desired.

Figure 7:
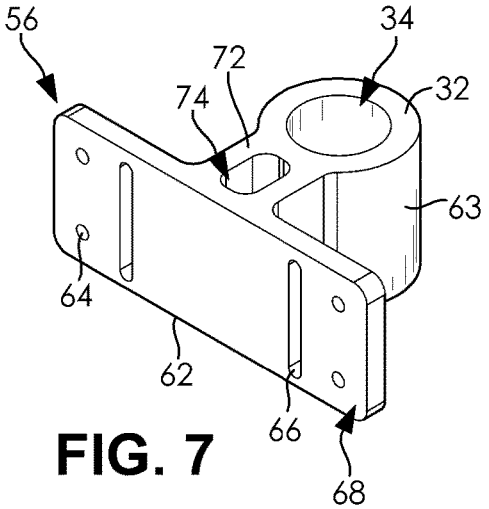
FIG. 7 is a top perspective view of a mount for use with the board holder shown in FIGS. 5 and 6.

With reference to FIGS. 7-9, the board holder 2 may have at least one mount 56 that allows the board holder 2 to be secured to a wall 58 or a punching bag 60, or other suitable structure. For example, the board holder 2 may include two mounts 56, however any number of mounts 56 may be chosen by a skilled artisan. As shown in FIG. 7, the mount 56 may have a base 62 and a base sleeve 63. The base 62 may have at least one aperture 64 and at least one slot 66. In a particular example, the at least one aperture 64 may include four apertures 64, where each aperture 64 is disposed on a corner 68 of the base 62. In another example, the at least one slot 66 may include two slots 66, where the base sleeve 63 is oriented between each slot 66. Each aperture 64 may be adapted to receive fasteners 44 that secure the mount 56 to the wall 58 (see FIG. 16, for example). Additionally, each slot 66 may be configured to receive a strap 70. For example, the strap 70 may be threaded through the slots 66 and then tightened around the punching bag 60 (see FIG. 15, for example). Other means for selectively affixing the mounts 56 to a surface including hook-and-loop fasteners, screws, bolts, springs, and the like, as non-limiting examples, may also be employed within the scope of the disclosure.

With renewed reference to FIGS. 7-9, the mount 56 may include at least one support 72 that connects the base 62 to the base sleeve 63. The at least one support 72 may include a plurality of supports 72. The plurality of supports 72 may also be spaced apart from one another and define at least one space 74 therebetween. Each space 74 formed between the supports 72 may reduce weight and lessen manufacturing costs. For example, as shown in FIG. 7, there may be two supports 72 creating a single space 74 therebetween. Other suitable configurations for the mount 56 may also be employed, as desired.

In operation, the base sleeve 63 may be configured to receive the elongate rod 4. In particular, the elongate rod 4 may be disposed through the opening 34 of the base sleeve 63. The opening 34 may be defined by the securing wall 32 of the base sleeve 63. In a further example, the base sleeve 63 may be an elastomeric material to secure the mount 56 to the elongate rod 4, as shown in FIGS. 7-8. In a further example, the base sleeve 63 may be attached to the first flange 38 and the second flange 48 (not shown). The base sleeve may be secured to the elongate rod 4 by tightening the at least one fastener 44 disposed through the at least one hole 46 formed in the first and the second flange 38, 40 (not shown). In another embodiment, as shown in FIG. 9, the mount 56 may be integral with the elongate rod 4 and may not require the base sleeve 63.

Figure 4:
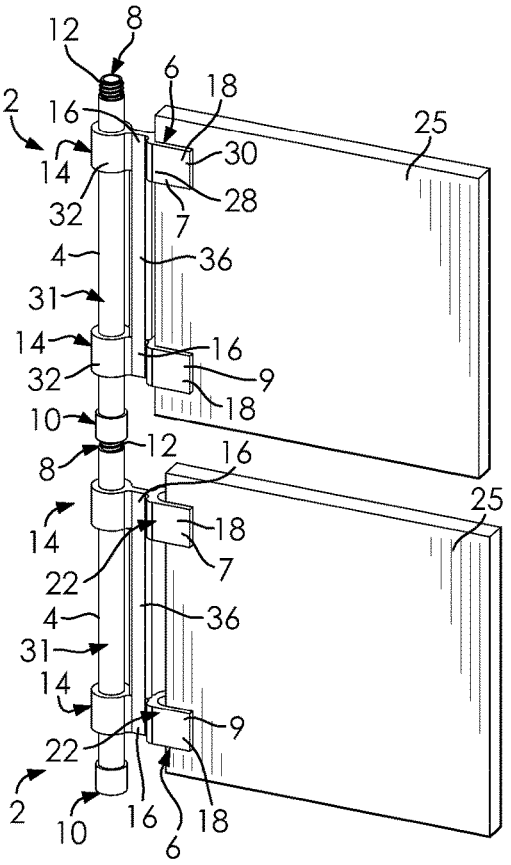
FIG. 4 is a top perspective view of two of the board holders shown in FIGS. 2 and 3, the board holders shown in a stacked arrangement with each of the board holders securing a board.

As shown in FIGS. 1, 3-4, 6, 8, 9, 11, 13, and 14-17, the clamps 6 may be secured to the elongate rod 4, and the board 25 may be disposed between the clamping walls 18, 20 of the first and second clamp 7, 9. It should be appreciated that any type of board 25, such as re-breakable boards (not shown), or other martial art training boards may be inserted into the clamps 6, as desired. As shown in FIG. 4, each elongate rod 4 may be stackable with an opposing elongate rod 4. Advantageously, the stackability of the elongate rods 4 may be employed to teach a student 76 how to strike a target at different heights and positions.

Figure 14:
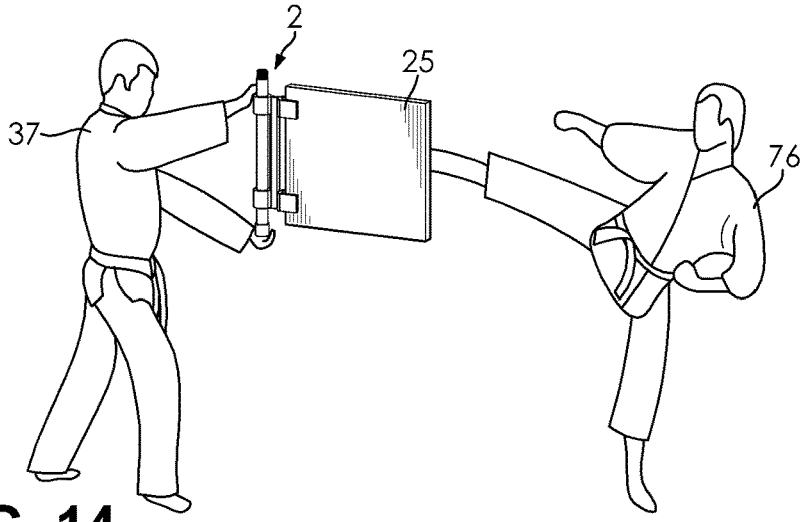
FIG. 14 is a side perspective view of a user gripping the board holder shown in FIG. 3, and showing a student kicking the board secured to the board holder.

In operation, as shown in FIG. 14, once the board 25 is secured in the clamps 6, the user 37 may grip the board holder 2. Once the user 37 orients the board 25 to the desired position, the student 76 may strike the board 25. Although only a single board holder 2 is shown in FIG. 14, it should be appreciated that multiple ones of the board holder 2 may be stacked as described herein in order to provide the student multiple boards 25 as targets.

Figure 15:
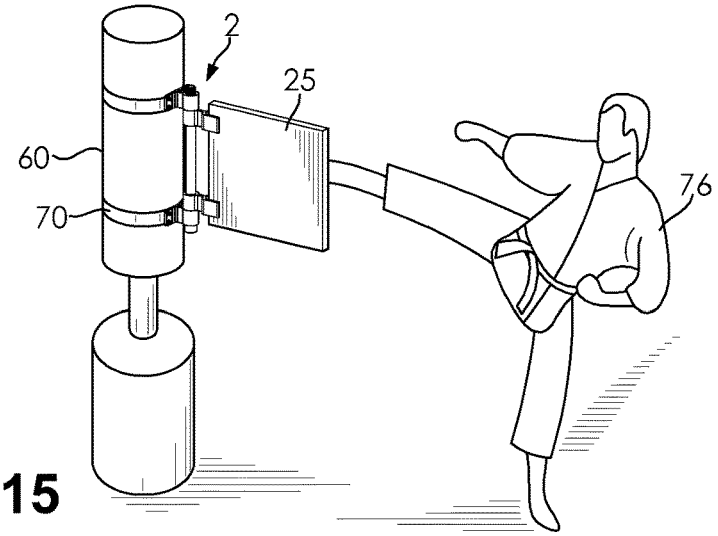
FIG. 15 is a top perspective view of the board holder shown in FIG. 8, the board holder shown attached to a bag and showing a student kicking a board secured to the board holder.

Moreover, the board holder 2 may be secured to another surface or structure such as the punching bag 60 shown in FIG. 15. To secure the mount 56 to the punching bag 60, the strap 70 may be threaded through each slot 66 in the mount 56, and then tightened around the bag 60. The board 25 may then be disposed in the clamps 6 and the student 76 may strike the board 25.

In another embodiment, as shown in FIG. 16, the board holder 2 may be mounted to the wall 58. To secure the mount 56 to the wall 58, the fasteners 44 may be inserted into the apertures 64, and then the fasteners 44 may be attached to the wall 58. The board 25 may then be placed in the clamps 6 and the student 76 may strike the board 25. It should be appreciated that the board holder 2 attached to the punching bag 60 or wall 58 may eliminate the need for another person to be present when the student 76 is training.

In a further embodiment, as shown in FIG. 17, a plurality of board holders 2 may be adapted to connect in various shapes. For example, the board holders 2 may be connected by a generally C-shaped rod 78, which permits the board holders 2 to be placed on the rod 78 in a variety of locations. A user may hold onto the C-shaped rod 78 by a holding rod, for example, that may be fastened to the C-shaped rod 78 with screws, bolts, or the like. However, the elongate rods 4 may be configured to connect in other shapes as chosen by one skilled in the art.

Advantageously, the board holders 2 may also be configured to selectively attached to a variety of different objections other than boards, including, as non-limiting examples, bricks, plastics, and rubber.

It should be appreciated that the board holder 2 militates against an inadvertent injury of the user 37 by securing the board 25 away from the user's 37 hand. In this way, the user 37 does not have to actually hold the board 25, and the board holder 2 will absorb the force of any misplaced strikes. Since the board holder 2 is also mountable on the punching bag 60 or the wall 58, as shown in FIGS. 15 and 16, the student 76 may advantageously train without the user 37. The training of the student 76 independent of the user 37 creates a safer and more efficient training experience.

The board holder 2 may be manufactured from a material, or a combination of materials, that is able to sustain pressure from a kick, such as rubber, plastic, cotton elastic, polyester elastic, polypropylene elastic, nylon elastic, carbon fiber, steel, and aluminum. However, a skilled artisan may choose other suitable materials for the board holder 2, within the scope of the present disclosure.

Advantageously, the board holder 2 militates against injury when a student 76 is breaking boards 25 and allows the students 76 to break boards independently.

While certain representative embodiments and details have been shown for purposes of illustrating the invention, it will be apparent to those skilled in the art that various changes may be made without departing from the scope of the disclosure, which is further described in the following appended claims.

What is claimed is:

1. A board holder, comprising:

an elongate rod having an exterior surface; and at least one clamp disposed on the exterior surface of the elongate rod, the at least one clamp having a first clamping wall and a second clamping wall, the first clamping wall and the second clamping wall adapted to secure a board, wherein the elongate rod is attached to at least one mount with a base, the base having at least one aperture and at least one slot, wherein the at least one mount has a base sleeve, the elongate rod disposed through the base sleeve, and wherein the base sleeve is selectively positionable along the exterior surface of the elongate rod, and wherein the at least one aperture includes four apertures and the at least one slot includes two slots, each of the four apertures is disposed at a corner of the mount, and the base sleeve is disposed between the two slots.

2. The board holder of claim 1, wherein the elongate rod is integrally molded with the least one clamp.

3. The board holder of claim 1, wherein the at least one mount is integrally molded to the elongate rod.

4. A board holder, comprising:

an elongate rod having an exterior surface; and at least one clamp disposed on the exterior surface of the elongate rod, the at least one clamp having a first clamping wall and a second clamping wall, the first clamping wall and the second clamping wall adapted to secure a board, wherein the at least one clamp has a clamp sleeve, the elongate rod disposed through the clamp sleeve, wherein the clamp sleeve is selectively positionable along the exterior surface of the elongate rod, wherein the at least one clamp includes a first clamp and a second clamp, the first clamp and the second clamp each has a middle portion connected to an elongate connecting body, wherein the clamp sleeve of the first clamp is spaced apart from the clamp sleeve of the second clamp, and wherein the clamp sleeve of the at least one clamp has a securing wall defining an opening that receives the elongate rod, the securing wall having a gap formed along a length of the securing wall, the at least one clamp further having a first flange and a second flange disposed on the securing wall on opposite sides of the gap.

5. The board holder of claim 4, wherein the at least one clamp is made from an elastomeric material.

6. The board holder of claim 4, wherein at least one hole is formed in the first flange and the second flange, and the at least one hole receives at least one fastener for selectively moving the first flange relative to the second flange.

7. The board holder of claim 6, wherein a width of the opening of the clamp sleeve is configured to change with the moving of the first flange relative to the second flange.

8. The board holder of claim 6, wherein the clamp sleeve is integral with the first flange and the second flange, the at least one clamp includes a first clamp and a second clamp, and the clamp sleeve connects the first clamp to the second clamp.

9. The board holder of claim 8, further comprising an elongate connecting body, wherein the first clamp and the second clamp each has a middle portion connected to the elongate connecting body, and the elongate connecting body is integral with the clamp sleeve.

10. The board holder of claim 1, wherein the first clamping wall and the second clamping wall each have an outer surface and an inner surface, the inner surface of the first clamping wall and the inner surface of the second clamping wall each have retaining features formed thereon.

11. The board holder of claim 10, wherein a biasing element is disposed on the outer surface of first clamping wall and the second clamping wall and configured to bias the first clamping wall toward the second clamping wall.

12. A stacked combination, comprising:

a first board holder and a second board holder, each of the first board holder and the second board holder including an elongate rod having an exterior surface, a male end, and a female end, and at least one clamp disposed on the exterior surface of the elongate rod, the at least one clamp having a first clamping wall and a second clamping wall, the first clamping wall and the second clamping wall adapted to secure a board, wherein the male end of the first board holder is disposed in the female end of second board holder in a stacked arrangement.

* * * * *